United States Patent [19]

Gardner et al.

[11] Patent Number: 5,035,777

[45] Date of Patent: Jul. 30, 1991

[54] PREPARATION OF ALKANESULFONYL HALIDES AND ALKANESULFONIC ACIDS

[75] Inventors: David M. Gardner, Worcester Township, Montgomery County, Pa.; Gregory A. Wheaton, Logan Township, Gloucester County, N.J.

[73] Assignee: Atochem North America, Inc., Philadelphia, Pa.

[21] Appl. No.: 511,867

[22] Filed: Apr. 20, 1990

Related U.S. Application Data

[63] Continuation-in-part of Ser. No. 164,599, Mar. 7, 1988, abandoned.

[51] Int. Cl.[5] ..... C25B 3/02

[52] U.S. Cl. ..... 204/79; 204/59 R

[58] Field of Search ..... 204/59 R, 72, 78, 79

[56] References Cited

U.S. PATENT DOCUMENTS

| | | | |
|---|---|---|---|
| 2,521,147 | 9/1950 | Brown | 204/79 |
| 3,626,004 | 12/1971 | Guertin | 260/543 R |
| 3,993,692 | 11/1976 | Giolito | 260/543 R |
| 4,280,966 | 7/1981 | Hubenett | 260/543 R |
| 4,609,438 | 9/1986 | Torii et al. | 204/72 |

FOREIGN PATENT DOCUMENTS

| | | |
|---|---|---|
| 0040560 | 11/1981 | European Pat. Off. . |
| 358313 | 11/1972 | U.S.S.R. . |
| 1350328 | 5/1971 | United Kingdom . |

*Primary Examiner*—John F. Niebling
*Assistant Examiner*—Steven P. Marquis
*Attorney, Agent, or Firm*—Panitch Schwarze Jacobs & Nadel

[57] ABSTRACT

A continuous method is provided for preparing alkanesulfonyl halides, particularly chlorides and alkanesulfonic acids in high yields without the formation of undesirable side-products, and without the net production of hydrogen chloride as a by-product. The method involves the continuous electrolysis of an alkanethiol (RSH) or dialkyl disulfide (RSSR') in an aqueous hydrochloric acid-containing solution, continuously removing the electrolyzed product mixture from the electrolysis zone, and recovering the alkanesulfonyl chloride ($RSO_2Cl$) or alkanesulfonic acid ($RSO_3H$) product from the mixture. The alkyl groups in the dialkyl disulfide (R and R') may be straight or branched chain, substituted or unsubstituted, have 1 to 20 carbon atoms, preferably 1 to 12 carbon atoms, and may be different, but are preferably the same. The aqueous hydrochloric acid-containing medium and any unreacted sulphur compounds may be recycled through the electrolysis chamber.

23 Claims, No Drawings

PREPARATION OF ALKANESULFONYL HALIDES AND ALKANESULFONIC ACIDS

Cross Reference to Related Application

This application is a continuation-in-part of our copending patent application Ser. No. 164,599, filed Mar. 7, 1988, now abandoned.

FIELD OF THE INVENTION

The present invention relates to a method for preparing alkanesulfonyl halides, particularly chlorides of the general formula $RSO_2Cl$ and alkanesulfonic acids of the general formula $RSO_3H$. More particularly, this invention concerns a method for producing alkanesulfonyl halides and alkanesulfonic acids from alkanethiols or dialkyl disulfides without the formation of undesirable side-products and by-product hydrogen halide.

BACKGROUND OF THE INVENTION

Alkanesulfonyl chlorides (also known as alkyl sulfonyl chlorides) are known for their utility in imparting functionality into various compounds or as intermediates to modify various compounds, including pharmaceuticals, agricultural chemicals, photographic chemicals and the like, in order to increase their efficacy, to protect sensitive functional groups during certain processing steps, or to improve the recovery and purity during isolation procedures.

Alkanesulfonic acids (also known as alkyl sulfonic acids) are known for their utility as acids and as solvents or catalysts for the preparation of a wide variety of compounds, including pharmaceuticals, agricultural chemicals, photographic chemicals, chemicals for the electronics industry and the like.

A number of prior-art methods are known for preparing alkanesulfonyl chlorides, particularly methanesulfonyl chloride, and alkanesulfonic acids, particularly methanesulfonic acid, but such prior-art methods have a number of disadvantages.

In U.S. Pat. No. 3,626,004 and in British Patent Specification No. 1,350,328, assigned to the same assignee as the present invention, R. M. Guertin discloses the continuous preparation of alkanesulfonyl chlorides and alkanesulfonic acids, respectively, by the reaction of chlorine with alkanethiols or dialkyl disulfides in an aqueous concentrated hydrochloric acid medium. In Japanese Pat. No. 7720970, a continuous process is disclosed for the preparation of methanesulfonyl chloride by reacting methanethiol with chlorine in aqueous hydrochloric acid. In U.S. Pat. No. 3,993,692, S. L. Giolito discloses the continuous preparation of methanesulfonyl chloride by reacting methanethiol and chlorine in saturated aqueous hydrochloric acid containing dispersed methanesulfonyl chloride in an agitated, baffled columnar reactor.

In U.S. Pat. No. 4,280,966, F. Hübenette discloses the batchwise or continuous preparation of alkanesulfonyl chlorides by reacting an alkanethiol or dialkyl disulfide with chlorine and water using the desired alkanesulfonyl chloride as the reaction medium. In European patent publication No. 0040560 and French patent publication No. 2,482,591, H. Gongora describes the continuous preparation of alkanesulfonyl chlorides by reacting chlorine with a stable emulsion of a dialkyl disulfide in water or aqueous hydrochloric acid, which is preformed in a separate mixing vessel with vigorous mechanical agitation.

Each of these methods has the disadvantage that large quantities of hydrogen chloride are produced as a by-product of the reaction according to one of the following general equations:

$$RSH + 3Cl_2 + 2H_2O \rightarrow RSO_2Cl + 5HCl$$

$$RSSR + 5Cl_2 + 4H_2O \rightarrow 2RSO_2Cl + 8HCl$$

$$RSH + 3Cl_2 + 3H_2O \rightarrow RSO_3H + 6HCl$$

$$RSSR + 5Cl_2 + 6H_2O \rightarrow 2RSO_3H + 10HCl$$

Thus, five and six moles of hydrogen chloride are produced for each mole of alkanesulfonyl chloride and alkanesulfonic acid formed, respectively, when an alkanethiol is used as the feed, and four and five moles of hydrogen chloride are produced for each mole of alkanesulfonyl chloride and alkanesulfonic acid formed, respectively, when a dialkyl disulfide is used as the feed. Disposal of this large amount of by-product hydrogen chloride presents a severe problem both from economic and environmental considerations.

Another problem associated with the preparation of alkanesulfonyl chlorides by reacting alkanethiols or dialkyl disulfides with chlorine is the formation of undesirable side-products arising from the chlorination of the alkyl side-chain. This problem becomes particularly serious in the preparation of alkanesulfonyl chlorides in which the alkyl side-chain contains two or more carbon atoms.

Production of alkanesulfonyl chlorides by the sulfochlorination of alkanes, which consists of irradiating a mixture of the alkane, sulfur dioxide and chlorine to stimulate the reaction, reduces the amount of by-product hydrogen chloride by 80% according to the following general equation:

$$RH\uparrow + Cl_2\uparrow + SO_2\uparrow \xrightarrow{h\nu} RSO_2Cl + HCl\uparrow$$

Sulfochlorination processes have been described in U.S. Pat. Nos. 3,147,303 and 3,458,419, German published application Nos. 2,123,449, 2,217,530, 2,459,159 and 2,805,441, Belgium Patent No. 820,662, German Patents Nos. 147,844, 149,513, 157,702 and 160,830, Russian Patent Nos. 516,683 and 772,106, French published patent application No. 2,575,468 and European published patent application No. 194,931. Although optimization of the alkane/$SO_2$/$Cl_2$ feed ratios has improved the yield of alkanesulfonyl chloride and minimized the production of unidentified "Heavy" by-products, sulfochlorination processes have several disadvantages:

1. Low normal alkanesulfonyl chloride yields;
2. Substantial contamination of the terminal alkanesulfonyl chloride product with non-terminal alkanesulfonyl chlorides when the alkane used as the feed contains three or more carbon atoms;
3. Considerable conversion of the alkane to chlorinated alkanes which increases purification costs and wastes raw materials; and
4. A requirement for highly pure alkane feeds to minimize contamination of the desired alkanesulfonyl chloride product with other alkanesulfonyl chlorides.

In European published patent application No. 194,931, despite substantial improvements, J. Ollivier reported yields of methanesulfonyl chloride of only 75% by the sulfochlorination of methane and that 18% of the methane which reacted was converted to chlorinated methanes. Ollivier obtained somewhat higher alkanesulfonyl chloride yields using propane and butane feeds, but 34% and 43% of the product, respectively, consisted of the 2-sulfonyl chloride isomer. In each case formation of these undesired side-products necessitates purification of the product alkanesulfonyl chloride. In addition, the sulfochlorination method of Ollivier produces only alkanesulfonyl chlorides and production of alkanesulfonic acids requires additional processing steps.

Alkanesulfonic acids have been produced without any attendant production of hydrogen chloride by several different methods: sulfoxidation of alkanes; catalyzed air oxidation of alkanethiols and dialkyl disulfides; catalyzed hydrogen peroxide oxidation of alkanethiols and dialkyl disulfides; and anodic oxidation of dialkyl disulfides. The methods are illustrated by the general equations below.

Sulfoxidation of Alkanes $$RH\uparrow + SO_2\uparrow + .5O_2 \xrightarrow{h\nu \text{ and/or initiator}} RSO_3H$$

Catalyzed Air Oxidation of Alkanethiols/Disulfides $$RSH + 1.5O_2\uparrow \xrightarrow{\text{Catalyst}} RSO_3H$$

$$RSSR + 2.5O_2\uparrow \xrightarrow{\text{Catalyst}} 2RSO_3H$$

Hydrogen Peroxide Oxidation of Thiols/Disulfides $$RSH + 3H_2O_2 \xrightarrow{\text{Catalyst}} 2RSO_3H$$

$$RSSR + 5H_2O_2 \xrightarrow{\text{Catalyst}} 2RSO_3H$$

Anodic Oxidation of Disulfides $$RSSR + 6H_2O \xrightarrow[\text{aq. } RSO_3H]{<e^->} 2RSO_3H + 5H_2\uparrow$$

Sulfoxidation processes have been disclosed in U.S. Pat. Nos. 3,260,741, 3,372,188, 3,413,337, 3,481,849, 3,485,870, 3,658,671, 3,682,803, 3,743,673, 3,926,757, 3,956,371 and 4,643,813, in German publication patent application Nos. 2,019,313, 2,118,363 and 2,924,427, in French published patent applications Nos. 1,531,897, 1,536,649 and 2,102,540, in British Patent Specification No. 1,194,699, in Japanese Patent Nos. 72/7777 and 84/204168, and in European Patent No. 194,201. All of these processes share one serious problem: co-production of very large quantities of sulfuric acid; typically, one mole of sulfuric acid for every 2–4 moles of alkanesulfonic acid. Removal of the by-product sulfuric acid from the alkanesulfonic acid is difficult and is the subject of several patents including German published patent application Nos. 2,014,783, 2,855,849, 3,048,058, 3,325,516, 3,325,517 and 3,412,844. However, none of these patented processes is able to reduce the sulfate content below 10,000 ppm by weight, which is too high for certain electrochemical applications.

In addition, sulfoxidation shares some of the disadvantages of sulfochlorination processes; specifically, poor selectivity for the terminal carbon with alkanes containing three or more carbon atoms, multiple sulfonation, a requirement for highly pure alkane feed to minimize contamination of the desired alkanesulfonic acid with other alkanesulfonic acids, and the fact that sulfoxidation produces only alkanesulfonic acids and is not suitable for production of alkanesulfonyl chlorides.

Catalyzed air oxidation of alkanethiols and/or dialkyl disulfides to alkanesulfonic acids has been described in U.S. Pat. Nos. 2,489,316, 2,489,317, 2,727.92,0 and 3,392,095. In all cases, the catalyst is a nitrogen dioxide ($NO_2$ or $N_2O_4$). Although catalyzed air oxidation is highly selective and produces much less sulfuric acid than does sulfoxidation—typically 1–2 percent by weight in the crude alkanesulfonic acid—the sulfuric acid levels are still too high for electrochemical applications. Moreover, the catalyzed air oxidation of alkanethiols or dialkyl disulfides produces only alkanesulfonic acids and is not capable of producing alkanesulfonyl chlorides.

Catalyzed hydrogen peroxide oxidation of alkanethiols and/or dialkyl disulfides has been disclosed in French published patent application No. 1,556,567, in German published patent application Nos. 2,504,201, 2,504,235 and 2,602,082 and in U.S. Pat. Nos. 3,509,206, 4,052,445 and 4,239,696. The catalyst used is either an ammonium or alkali molybdate or tungstate or the alkanesulfonic acid itself. Nielsen (U.S. Pat. No. 3,509,206) reported that the level of sulfuric acid in the crude 70 percent by weight methanesulfonic acid produced by hydrogen peroxide oxidation of methanethiol or dimethyl disulfide was 0.37 percent by weight which is 10–20 times higher than may be tolerated in electrochemical applications. In addition, this method produces only alkanesulfonic acids and is not capable of producing alkanesulfonyl chlorides.

Anodic oxidation of dialkyl disulfides in an aqueous solution of the corresponding alkanesulfonic acid was disclosed by B. K. Brown in U.S. Pat. No. 2,521,147. This process is economically unattractive because of the low current densities required to achieve reasonable current efficiencies (20 milliamperes/$cm^2$ to achieve 80% current efficiency) and because of the large amount of sulfuric acid co-product produced. In a direct current electrolysis Brown reported that the alkanesulfonic acid to sulfuric acid molar ratio was 3:1 with a current efficiency of 80%. Electrolysis using alternating current produced only one-fourth the amount of sulfuric acid as was produced using direct current, but the current efficiency using alternating current was only 17%. In addition, the anodic oxidation method is capable of producing only alkanesulfonic acids and not alkanesulfonyl chlorides.

In Russian Patent No. 358,313 A. P. Tomilov discloses the preparation of 2-chloroalkanesulfonyl chlorides ($RCHClCH_2SO_2Cl$) by the batchwise electrolytic oxidation of di-2-chloroalkyl disulfides ($RCHClCH_2SSCH_2CHClR$) in an aqueous concentrated hydrochloric acid medium at 10–18 degrees Centigrade. Although this method circumvents the disadvantageous formation of large quantities of by-product hydrogen chloride, the yields of the desired alkanesulfonyl chloride product are only 70% to 80%. More importantly, the current efficiency, which is an important economic consideration, is low (only 38% to 41%), and this method is limited to production of 2-chloroalkanesulfonyl chlorides.

None of these reported prior-art methods for the production of alkanesulfonyl chlorides or alkanesulfonic acids has the advantages of the method of the present invention.

BRIEF SUMMARY OF THE INVENTION

According to the present invention, a continuous method is provided for preparing an alkanesulfonyl chloride of the formula $RSO_2Cl$ or an alkanesulfonic acid of the formula $RSO_3H$ where R is an alkyl group having one to 20 carbon atoms, in high yield which comprises passing a mixture of an alkanethiol or dialkyl disulfide in an aqueous hydrochloric acid-containing medium into an electrolysis zone or chamber and continuously removing the electrolyzed product mixture, from which the alkanesulfonyl chloride or alkanesulfonic acid product can be recovered. The aqueous hydrochloric acid electrolyte containing alkanesulfonic acid and/or suspended unconverted alkanethiol or dialkyl disulfide may be recycled to the electrolysis zone.

Alkanesulfonyl bromides of the general formula $RSO_2Br$ or alkanesulfonic acids of the general formula $RSO_3H$, where R is the same as described above, may also be prepared according to the method of this invention by replacing the hydrochloric acid in the aqueous electrolyte medium by hydrobromic acid. However, the yields of the alkanesulfonyl bromides or alkanesulfonic acids which are obtained using hydrobromic acid instead of hydrochloric acid are low due to the incomplete oxidation of the reactants.

DETAILED DESCRIPTION OF PREFERRED EMBODIMENTS

While the following description refers only to the preparation of alkanesulfonyl chlorides, it will be understood that bromides are also intended to be included in the same manner. Theoretically, other halides such as iodides and fluorides could be prepared according to the invention. However, hydroiodic acid is an even weaker oxidizing agent than hydrobromic acid and would probably require a catalyst to oxidize disulfides at normal reaction temperatures. The use of hydrofluoric acid would require specially constructed electrolysis cells and might result in formation of undesirable fluoromethanesulfonyl fluorides.

The alkanethiol (also known as alkyl mercaptan) and dialkyl disulfide reactants, which can be employed in the process of this invention may be represented by the formula RSX, where X is hydrogen or a radical of the formula SR' and where R and R' are alkyl groups having one to 20 carbon atoms, and preferably one to 12 carbon atoms. R and R' can be the same or different alkyl groups, but are preferably the same. The alkyl groups may be branched or straight-chain and may also be substituted alkyl radicals having such substituent atoms and groups as hydroxyl, chlorine, bromine, fluorine, amine ($NH_2$), sulfonic acid ($SO_3H$), sulfonyl chloride ($SO_2Cl$) and $SO_3R$. However, the alkyl groups are preferably not substituted directly with halogens (nonhalogen substituted) and more preferably the alkyl groups are unsubstituted.

The most preferred reactants are methanethiol and dimethyl disulfide. However, the process of this invention is not limited and is useful for producing the corresponding alkanesulfonyl chlorides and alkanesulfonic acids using reactants such as ethanethiol, the propanethiols, the butanethiols, the pentanethiols, the hexanethiols, the heptanethiols, the octanethiols, the nonanethiols,the decanethiols, the dodecanethiols, diethyl disulfide, dipropyl disulfides, dibutyl disulfides, dioctyl disulfides, and the like. Of these, the ethane and octane thiols and the diethyl and dioctyl disulfides are preferred.

In the method of this invention, the electrolytic oxidation is carried out in a medium comprising aqueous hydrochloric acid or an aqueous mixture of hydrochloric acid and the corresponding alkanesulfonic acid. The concentration of hydrogen chloride in the hydrochloric acid-containing medium should be between about eight percent by weight and the saturation concentration of hydrogen chloride in the aqueous medium at the temperature of the reaction medium in the electrolysis chamber. For the production of alkanesulfonyl chlorides the preferred concentration of hydrogen chloride in the reaction medium is from about 20 percent by weight to about 38 percent by weight with higher concentrations being preferred in order to increase the conductivity of the electrolyte.

The concentration of hydrogen chloride in an aqueous solution of alkanesulfonic acid varies as the concentration of the alkanesulfonic acid varies, decreasing as the concentration of the alkanesulfonic acid increases (for example: the concentration of hydrogen chloride varies from about 15 percent by weight at the methanesulfonic acid concentration of 36 percent by weight to about eight percent by weight at a methanesulfonic acid concentration of 75 percent by weight at a temperature of 85 degrees Centigrade). Therefore, for the production of alkanesulfonic acids the preferred concentration of hydrogen chloride in the aqueous reaction medium is between at least eight percent by weight and the saturation concentration of hydrogen chloride in the aqueous alkanesulfonic acid-containing reaction medium at the preferred temperature of the reaction medium in the electrolysis chamber.

The alkanethiol or dialkyl disulfide reactant can be previously mixed with the aqueous hydrogen chloride-containing medium to provide a stable suspension of the alkanethiol or dialkyl disulfide in the aqueous medium prior to addition to the electrolysis chamber or the alkanethiol or dialkyl disulfide and the aqueous hydrogen chloride-containing medium can both be added separately to the electrolysis chamber. The alkanethiols are slightly soluble in the hydrogen chloride-containing medium, but the longer chain length alkanethiols and the dialkyl disulfides are relatively insoluble, so that a suspension must be formed in the aqueous hydrogen chloride-containing medium. Further, the preferred reactants methanethiol (methyl mercaptan) and dimethyl disulfide are relatively volatile, low boiling liquids. Therefore, if the electrolysis chamber is not enclosed, it is desirable to provide a means for condensing the volatile reactants and returning them to the electrolysis chamber such as a reflux condenser to prevent loss of the reactants during the vigorous exothermic reaction.

While the applicants do not wish to be bound by any particular theory, it is believed that electrolysis of the solution containing hydrogen chloride and the sulfur-containing reactant (RSX) produces a chlorine-containing oxidant in situ, thereby oxidizing the alkanethiol or dialkyl disulfide, either in the bulk of the reaction solution or on or very near the surface of the anode, to the corresponding alkanesulfonyl chloride which can, if so desired, be hydrolyzed in situ to produce the corresponding alkanesulfonic acid and hydrogen chloride. The co-produced hydrogen chloride is redissolved in the aqueous reaction medium within the electrolysis zone.

Since the solubilities of the alkanethiols and dialkyl disulfides are very low in the aqueous hydrogen chloride-containing medium (only about four to five percent by weight maximum), it is desirable to have the concentration of the sulfur-containing reactant as close as possible to the saturation point in the hydrogen chloride-containing solution.

In the process of the present invention, the cell voltage which is used can be from about 2 volts to about 5 volts, and the preferred cell voltage which is used is from about 2.3 volts to about 3 volts.

In the method of the present invention the current density which is used can be about 0.02 ampere per square centimeter to about one ampere per square centimeter. The preferred current density is about 0.1 ampere per square centimeter to about 0.5 ampere per square centimeter. During the production of alkanesulfonyl chlorides it is preferred that the current density be maintained at about 0.5 ampere per square centimeter. However, during the production of alkanesulfonic acids the solubility of hydrogen chloride in the aqueous alkanesulfonic acid-containing electrolyte medium decreases as the concentration of the alkanesulfonic acid increases, which results in an increase in the cell voltage when the current density is maintained constant. Therefore, during the production of alkanesulfonic acids it is preferred that the current density be decreased as the concentration of the alkanesulfonic acid in the aqueous electrolyte increases so that the cell voltage remains constant within the preferred range of about 2.3 volts to about 3 volts.

It is preferred that the current used be sufficient to provide a slight excess of electrical energy over that required to completely oxidize the alkanethiol or the alkyl disulfide introduced into the electrolysis zone. That is, at least six Faradays (electrical equivalents) should be provided for every gram-mole of alkanethiol introduced into the electrolysis chamber, and at least ten Faradays should be provided for each gram-mole of dialkyl disulfide introduced into the electrolysis chamber. It is preferred that the electrical power provided be from about 0.5 percent to about 5 percent in excess of that required to completely oxidize the alkanethiol or dialkyl disulfide reactant introduced into the electrolysis chamber. The residence time of the reactants in the electrolysis zone is the time required to convey the necessary current to effect the complete oxidation of the reactants. The residence time is an important feature of the present invention and ranges from several seconds to about 1 hour, and most preferably from about 1 to 30 minutes. Residence times in this range provide better current efficiency and higher yields.

The temperature at which the electrolytic oxidation is carried out can be from about zero degrees Centigrade to about 120 degrees Centigrade. However, at temperatures less than about 15 degrees Centigrade the electrolysis reaction is adversely affected by a decrease in the solubility of the alkanethiol or dialkyl disulfide reactants in the aqueous hydrochloric acid-containing medium and by a decrease in the conductivity of the aqueous hydrochloric acid-containing electrolyte. At temperatures greater than about 100 degrees Centigrade the electrolysis reaction is adversely affected by a decrease in the solubility of hydrogen chloride in the aqueous medium resulting in a decrease in the conductivity of the aqueous electrolyte.

At temperatures greater than about 40 degrees Centigrade the yield of the product alkanesulfonyl chloride is adversely affected by subsequent hydrolysis of the alkanesulfonyl chloride in the aqueous medium to produce the corresponding alkanesulfonic acid. Therefore, when the alkanesulfonyl chloride is the desired product, it is preferred that the electrolysis reaction be carried out at a temperature of about 15 degrees Centigrade to about 40 degrees Centigrade, and most preferably at a temperature of about 18 degrees Centigrade to about 25 degrees Centigrade.

Below a temperature of about 50 degrees Centigrade the alkanesulfonyl chloride is hydrolyzed very slowly in the aqueous reaction medium to produce the corresponding alkanesulfonic acid. Therefore, when the alkanesulfonic acid is the desired product, it is preferred that the electrolysis reaction be carried out at a temperature of about 50 degrees Centigrade to about 100 degrees Centigrade, and most preferably at a temperature of about 75 degrees Centigrade to about 90 degrees Centigrade.

The method of this invention may be carried out at subatmospheric, atmospheric, or superatmospheric pressures. It is preferred that the practice of this invention be carried out at substantially atmospheric pressure.

The aqueous hydrochloric acid in the electrolyzed product mixture may be recovered, after separation of the product alkanesulfonyl chloride or alkanesulfonic acid by methods known to those skilled in the art, and recycled to the electrolysis chamber if so desired. Methods for the separation of the product alkanesulfonyl chloride from an aqueous hydrochloric acid solution are known in the art and primarily involve decantation. As described in U.S. Pat. No. 3,626,004, when the alkanesulfonyl chloride has from 1 to 4 carbon atoms, the specific gravity thereof is greater than that of the concentrated aqueous hydrochloric acid medium. On the other hand, where the alkanesulfonyl chloride has from 5 to 20 carbon atoms, the specific gravity thereof is less than that of the aqueous hydrochloric acid medium, and the product will rise to the top of the separation zone or chamber.

The separation of the product and its decantation is facilitated by maintaining a sufficient differential of specific gravities between the aqueous medium and the alkanesulfonyl chloride product layers by continuously or intermittently withdrawing a small portion of the aqueous reaction medium from the product separation zone and/or continuously or intermittently adding fresh water or aqueous hydrochloric acid solution to maintain the specific gravity differential and the proper liquid level in the separation zone.

The electrodes used in the method of this invention can be constructed of any materials which are both highly conductive and compatible with the alkanethiol or dialkyl disulfide reactants, the aqueous hydrochloric acid-containing electrolyte, chlorine, hydrogen, and the product alkanesulfonyl chlorides and alkanesulfonic acids. The electrodes may be constructed from, for example, platinum, gold, graphite, titanium plated with platinum, and the like. It is preferred that the anode used be graphite or a material similar to the various dimensionally-stable metal oxide/metal anodes which have been developed for use in the electrolysis of aqueous brine solutions, for example, titanium coated with titanium oxide and/or ruthenium oxide. It is preferred that the cathode used be constructed of graphite or platinum.

The design of the electrolysis chamber of the method of this invention is not critical. However, the design of the electrolysis chamber should provide sufficient turbulence, either by mechanical agitation, by static mixing, or by the turbulence produced by the evolution of gaseous hydrogen from the cathode surface, to maintain the slightly soluble alkanethiol or dialkyl disulfide reactant in a highly dispersed state within the electrolysis chamber. The electrolysis chamber may consist of a single compartment or may consist of two or more compartments in which the anode compartments and cathode compartments are separated by diaphragms or selectively permeable membranes such as are employed in the manufacture of chlorine and sodium hydroxide from aqueous brine solutions. The method may be carried out in a single electrolysis chamber or may utilize two or more electrolysis chambers in series or parallel.

The method of the present invention has several advantages over the chlorine oxidation methods of Guertin, Giolito, Hubennett, or Gongora, et al., in that the method of the present invention does not result in the net production of hydrogen chloride as a by-product, thus eliminating the need for disposal of the by-product, hydrogen chloride. The by-product hydrogen produced in the process of this invention can be recovered and used for fuel. The addition of gaseous chlorine to the aqueous reaction media embodied in the aforementioned methods of Guertin, Giolito, Hubennett or Gongora, et al., can result in localized regions of either high chlorine concentration or chlorine deficiency in the liquid reaction medium, even under conditions of high mechanical agitation. These can result in overoxidation of the alkanethiol or dialkyl disulfide reactant to produce, ultimately, sulfuric acid, chlorination of the alkyl group of the product alkanesulfonyl chloride or alkanesulfonic acid, or incomplete oxidation of the alkanethiol or dialkyl disulfide reactant. The latter condition results in the formation of undesirable, oxidizable and, often, odorous impurities in the product alkanesulfonyl chloride or alkanesulfonic acid. In the method of the present invention the amounts of impurities in the product alkanesulfonyl chloride or alkanesulfonic acid due to overoxidation, chlorination of the alkyl group, or incomplete reaction are low.

The method of the present invention has several advantages over the other aforementioned prior-art methods which do not involve chlorine oxidation. The method of this invention can produce either an alkanesulfonyl chloride or an alkanesulfonic acid in a single step, which the other aforementioned prior-art methods cannot do, in yields of at least 80% and generally in yields of 90% or greater. The method of this invention produces only a single isomeric alkanesulfonyl chloride or alkanesulfonic acid corresponding to the alkanethiol or dialkyl disulfide isomer used as the reactant, and the method of this invention produces no detectable chlorinated hydrocarbon side-products.

The method of this invention has several advantages over the aforementioned electrolytic oxidation methods of Brown or Tomilov (Compare Comparative Example 1, illustrating the batchwise method of Tomilov, with Examples 2 to 6 below which illustrate the method of this invention). Using the method of this invention the current efficiency is high; i.e., at least 70% and usually at least 90%, based on the amount of product alkanesulfonyl chloride or alkanesulfonic acid produced and the electrical power consumed. The yield of the product alkanesulfonyl chloride or alkanesulfonic acid is also high; i.e., at least 80% and usually at least 95%, based on either the alkanethiol or dialkyl disulfide reactant. The method of this invention can produce either an alkanesulfonyl chloride or an alkanesulfonic acid, whereas the method of Brown produces only alkanesulfonic acids and the method of Tomilov produces only 2-chloroalkanesulfonyl chlorides.

It is surprising and unexpected that our laboratory data indicate that the current efficiency (i.e., the yield of desired product based on the electrical current used) of the process improves as the residence time of the reactants in the electrolysis cell decreases. The data for the formation of methanesulfonyl chloride in Examples 1, 2, 4 and 6 are tabulated below:

TABLE I

| Example | Residence Time (min.) | Current Efficiency | Yield |
|---|---|---|---|
| 1 | 360 | 44% | 17% |
| 2 | 28 | 84% | 99% |
| 4 | 1.5 | 96% | 99% |
| 6 | 0.22 | 99% | 90% |

The above data show that the current efficiency generally improves, by some unknown mechanism, as the residence time decreases. This is an unexpected benefit in that electrical energy is a necessary reactant in the process, and for economic reasons it is very desirable to use the minimum amount of electrical energy to produce the desired change. The data in the above Table I also indicate that the yield (i.e., the selective use of the chemical reactants to produce the desired product) is improved as the residence time decreases. It does appear, however, that at some residence time shorter than about 1.5 minutes, the yield begins to decrease with the time.

The invention will now be illustrated in further detail by reference to the following specific, non-limiting examples:

COMPARATIVE EXAMPLE 1

This example illustrates the low current efficiency obtained in the preparation of methanesulfonyl chloride by the batchwise electrolytic oxidation of dimethyl disulfide in a concentrated hydrochloric acid medium according to the method of Tomilov.

Dimethyl disulfide (5.30 gm) and concentrated hydrochloric acid (37.1 percent HCl by weight, 35 ml, 41.30 gm) were combined in a threenecked round bottom flask equipped with a TEFLONcoated magnetic stirring bar, a thermometer, a reflux condenser and two platinum electrodes, each consisting of a 1.5 cm diameter platinum disc spotwelded to the end of a 10 cm length of 1 mm diameter platinum wire. The electrodes were suspended in the flask by inserting the wire leads through a rubber stopper inserted in the center neck of the flask. The electrodes were spaced about 4–5 mm apart. The mixture was electrolyzed for six hours with vigorous stirring using a current of 2.5 amperes at a voltage of 5.0 volts D.C. A 17 percent yield of methanesulfonyl chloride was obtained, and the current efficiency was only about 44 percent.

EXAMPLE 2

A continuous-flow electrolysis cell was constructed from 30 mm diameter glass tubing with a glass inlet tube located on one side about 1 cm up from the bottom of the cell and a liquid take-off tube (equipped with a siphon-break and a shut-off valve) located on the opposite side of the cell about 5 cm up from the bottom of the cell. A 14/20 ground-glass side-neck was located on the inlet side about 8 cm up from the bottom of the cell, and a threaded thermometer adapter was attached to the front of the cell about 7 cm up from the bottom of the cell. The cell had a volume of about 20 ml. to a 29/42 groundglass outer joint at the top into which fit a TEFLON stopper. The stopper was equipped with two small holes (less than 1 mm in diameter) centered about 1 cm apart.

The electrode assembly, which consisted of two parallel platinum plates (1.1 cm ×4.4 cm active surface) embedded in a TEFLON bar along the length on each side of the bar to secure the plates 4 mm apart, was suspended in the cell by passing the 1 mm diameter platinum wire lead from each electrode through the holes in the TEFLON stopper. The electrode leads were connected to a variable voltage DC power source.

The cell was equipped with a TEFLONcoated magnetic stirring bar, a thermometer, and a reflux condenser. The inlet of the cell was connected to the discharge side of a peristaltic pump using VITON tubing. The suction side of the peristaltic pump was connected to a feed reservoir by a length of VITON tubing. A 50 ml Erlenmeyer flask immersed in an ice bath served as the receiver for the liquid effluent from the liquid take-off tube of the electrolysis cell.

A mixture of 1.66 gm of dimethyl disulfide ($CH_3SSCH_3$) and 250 ml of concentrated hydrochloric acid (37.1 percent HCl by weight) was passed through the continuous-flow electrolysis cell at a flow-rate of 0.72 ml/min (0.85 gm/min). The mixture in the cell was stirred vigorously using the magnetic stirring bar, and a current of 0.40 ampere at 2.40 volts DC was passed through the cell. The residence time was about 28 minutes. Methanesulfonyl chloride ($CH_3SO_2Cl$) was produced in 99.0 percent yield at a current efficiency of 84.4 percent. No products exhibiting chlorination of the methyl group could be detected.

EXAMPLE 3

This example illustrates the production of n-propanesulfonyl chloride by the electolytic oxidation of n-propanethiol by the method of this invention.

A suspension of D-propanethiol (0.80 gm) and 100 ml of concentrated hydrochloric acid (37.1 percent HCl by weight) was passed through the apparatus used in Example 2 at a rate of 5 ml/min. The electrolysis cell was immersed in a water bath to maintain the temperature of the mixture in the cell at 22–25 degrees Centigrade. A current of 3.50 amperes at 2.60 volts DC was passed through the cell to produce n-propanesulfonyl chloride ($CH_3CH_2CH_2SO_2Cl$) in 80 percent yield at a current efficiency of 73 percent. The residence time was about 7 minutes. No products exhibiting chlorination of the propyl group were detected.

EXAMPLE 4

In this example, which illustrates recycle of the hydrochloric acid electrolyte, a commercially available small, undivided (i.e., no membrane between the electrodes), plate-and-frame electrochemical cell (MICRO FLOW CELL manufactured by Electro Cell AB of Akersberga, Sweden) was used. The cell was constructed from TEFLON except for the electrodes and the mounting bolts. The anode was a dimensionally-stable ruthenium oxide/titanium oxide on titanium anode (obtained from Eltech Systems), and the cathode consisted of titanium plated with platinum. The active electrode surface was 10 square centimeters, and the inter-electrode spacing was 4 mm. The liquid volume of the cell was about 4 ml. The cell was run at a constant current of 3.50 amperes and a voltage of 2.40–2.50 volts DC.

The feed to the cell consisted of a combination of a fresh feed mixture of dimethyl disulfide (one percent by weight) and concentrated hydrochloric acid (37.1 percent HCl by weight) and recycled electrolyte containing about 36.5 percent HCl by weight. Both the fresh feed and the product reservoirs were initially charged with the dimethyl disulfide/hydrochloric acid mixture. The fresh feed mixture and the recycled electrolyte were each pumped at a flow-rate of 1.3 ml/min and combined just prior to entering the electrochemical cell. The residence time was 1.5 minutes. Samples of the combined feed to the cell and the effluent product mixture from the cell were collected hourly and analyzed by gas chromatography. Under these conditions dimethyl disulfide was selectively and efficiently oxidized to methanesulfonyl chloride in 99 percent yield at a current efficiency of 96 percent. No products exhibiting chlorination of the methyl group could be detected.

EXAMPLE 5

This example illustrates the production of ethanesulfonyl chloride by the electrolytic oxidation of diethyl disulfide according to the method of this invention.

The same electrolysis cell used in Example 4 was used except that both the anode and the cathode were constructed from graphite (POCO Graphite AXF-51-BG) and the inter-electrode gap was adjusted to 2 mm. The diethyl disulfide was pumped directly into the electrolysis chamber through a glass tube (3 mm diameter) with a sintered-glass frit on the end, which was inserted into the bottom of the electrolysis chamber through the TEFLON frame of the cell, using a syringe pump at a flowrate of 0.040 ml/min. Concentrated hydrochloric acid (37.1 percent HCl by weight) was charged to a reservoir consisting of a 1000 ml resin kettle equipped with a cooling jacket through which an aqueous ethylene glycol solution was circulated from a constant-temperature circulating cooling bath. The contents of this reservoir were cooled and maintained at a temperature of 5–8 degrees Centigrade and were circulated through the electrolysis cell and back to the reservoir at a flow-rate of 15.0 ml/min. The cell was operated at a current of 5.0–5.1 amperes at 4.5–4.9 volts DC. The temperature of the reaction mixture within the electrolysis chamber was 14-18 degrees Centigrade. The residence time was 0.13 minute. The effluent from the cell was collected in the reservoir and recycled. Samples of the contents of the reservoir were collected periodically over a three-day period and analyzed by gas chromatography. Under these conditions, ethanesulfonyl chloride was produced in an 87 percent yield with a current efficiency of 94 percent. No products exhibiting chlorination of the ethyl group could be detected.

EXAMPLE 6

This example illustrates the production of methanesulfonic acid from dimethyl disulfide according to the method of this invention.

The plate-and-frame cell electrolysis apparatus described in Example 5 was used. The reservoir was charged with an aqueous solution containing 36 percent methanesulfonic acid by weight and 15 percent hydrogen chloride by weight and the reservoir was heated and maintained at a temperature of 72–76 degrees Centigrade. This aqueous solution was recirculated through the cell at a flow-rate of 18.0 ml/min and dimethyl disulfide was added directly to the electrolysis chamber of the cell at a flow-rate of 0.015 ml/min. A current of 2.5–2.6 amperes at 2.6–2.8 volts DC was passed through the cell and the temperature of the reaction mixture within the cell rose to 82–87 degrees Centigrade. The residence time was 0.22 minute. Under these conditions methanesulfonic acid was produced in a yield of 90 percent with a current efficiency of over 99 percent.

The present invention may be embodied in other specific forms without departing from the spirit or essential attributes thereof and, accordingly, reference should be made to the appended claims, rather than the specification, as indicating the scope of the invention.

We claim:

1. A continuous method of preparing alkanesulfonyl halides of the formula $RSO_2Y$, wherein Y is chlorine or bromine, or alkanesulfonic acids of the formula $RSO_3H$, wherein R is a non-halogen substituted or unsubstituted alkyl group having one to 20 carbon atoms, comprising the continuous-flow electrolysis of a sulfur compound of the formula RSX, wherein X is hydrogen or a radical of the formula SR′ and where R and R′ are non-halogen substituted or unsubstituted alkyl groups having one to 20 carbon atoms, in an aqueous hydrohalic (HY) acid-containing medium to oxidize the sulfur compound, continuously removing electrolyzed product mixture from the electrolysis zone, and recovering the alkanesulfonyl halide or alkanesulfonic acid from the product mixture.

2. A method according to claim 1 wherein the aqueous hydrohalic acid-containing medium contains hydrogen chloride in a concentration of about eighty percent b weight to 38 percent by weight.

3. A method according to claim 1 wherein the temperature of the electrolysis is about zero to 120 degrees Centigrade.

4. A method according to claim 3 wherein the temperature is about 18 to 30 degrees Centigrade when the alkanesulfonyl chloride is the desired product and is about 75 to 100 degrees when the desired product is the alkanesulfonic acid.

5. A method according to claim 1 wherein the electrical current used for the electrolysis is slightly in excess of that theoretically required to completely oxidize the sulfur compound.

6. A method according to claim 5 wherein the excess is about 0.5 to 5 percent.

7. A method according to claim 5 wherein the sulfur compound is an alkanethiol of the formula RSH and the current used is at least six Faradays per gram-mole of alkanethiol.

8. A method according to claim 5 wherein the sulfur compound is a dialkyl disulfide of the formula RSSR′ and the current is at least ten Faradays per gram-mole of dialkyl disulfide.

9. A method according to claim 1 wherein the current density of the electrolysis is about 0.02 to one ampere per square centimeter.

10. A method according to claim 9 wherein the current density is about 0.1 to 0.5 ampere per square centimeter.

11. A method according to claim 1 wherein the aqueous hydrohalic acid in the product mixture is recycled to the electrolysis zone after recovery of the alkanesulfonyl halide or alkanesulfonic acid.

12. A method according to claim 1 wherein the sulfur compound is suspended in the aqueous hydrohalic acid-containing medium prior to feeding to the electrolysis zone.

13. A method according to claim 1 wherein the sulfur compound is an alkanethiol of the formula RSH with the alkyl group having one to 12 carbon atoms.

14. A method according to claim 13 wherein the alkanethiol is selected from the group consisting of methanethiol, ethanethiol, propanethiols, butanethiols, octanethiols, and dodecanethiols.

15. A method according to claim 1 wherein the sulfur compound is a dialkyl disulfide of the formula RSSR′ with each alkyl group having one to 12 carbon atoms.

16. A method according to claim 15 wherein R and R′ are the same.

17. A method according to claim 16 wherein the dialkyl disulfide is selected from the group consisting of dimethyl disulfide, diethyl disulfide, dipropyl disulfides, and dibutyl disulfides.

18. A method according to claim 1 wherein either or both alkyl groups are substituted with atoms or groups selected from the group consisting of hydroxyl, amine, $SO_3H$, sulfonyl chloride, and $SO_3R$ where R is an alkyl group.

19. A continuous method of preparing an alkanesulfonyl chloride of the formula $RSO_2Cl$, wherein R is a non-halogen substituted or unsubstituted alkyl group having one to 20 carbon atoms which comprises the continuous-flow electrolysis of a sulfur-containing reactant having the formula RSX and where X is hydrogen or a radical of the formula SR′ and where R and R′ are non-halogen substituted or unsubstituted alkyl radicals having one to 20 carbon atoms, in an aqueous hydrochloric acid-containing medium containing about 8 to 38 percent by weight of hydrogen chloride by continuously passing a mixture of the sulfur-containing reactant and the aqueous hydrochloric acid-containing medium into an electrolysis chamber maintained at a temperature of about zero to 40 degrees Centigrade through which an electrical current slightly in excess of that theoretically required to completely oxidize the sulfur-containing reactant to the product alkanesulfonyl chloride is passed using a current density of about 0.02 to 1 ampere per square centimeter and continuously removing from the electrolysis chamber the electrolyzed product mixture from which the product alkanesulfonyl chloride is recovered.

20. A continuous method of preparing an alkanesulfonic acid of the formula $RSO_3H$ wherein R is an alkyl grouup having one to 20 carbon atoms which comprises the continuous-flow electrolysis of a sulfur-containing reactant having the formula RSX, where X is hydrogen or a radical of the formula SR′ and where R and R′ are alkyl radicals having one to 20 carbon atoms in an aqueous hydrochloric acid-containing medium, wherein hydrogen chloride is about eight percent by weight to the saturation concentration of hydrogen chloride in the aqueous medium at the temperature of the electrolysis, by continuously passing a mixture of the sulfur-containing reactant and the aqueous hydrochloric acid-containing medium into an electrolysis chamber maintained at a temperature of about 50 to 100 degrees Centigrade through which an electrical current slightly in excess of that theoretically required to completely oxidize the sulfur-containing reactant to the product alkanesulfonic acid is passed using a current density of about 0.02 to one ampere per square centimeter and continuously removing from the electrolysis chamber the electrolyzed product mixture from which the product alkanesulfonic acid is recovered.

21. A method according to claim 1 wherein the residence time of the reactants in the electrolysis zone is less than about 1 hour.

22. A method according to claim 21 wherein the residence time is about 1 to 30 minutes.

23. A continuous method of preparing an alkanesulfonic acid of the formula $RSO_3H$, wherein R is an alkyl group having one to 20 carbon atoms, comprising the continuousflow electrolysis of a sulfur compound of the formula RSX, wherein X is hydrogen or a radical of the formula SR′ and where R and R′ are alkyl groups having one to 20 carbon atoms in an aqueous hydrohalic acid-containing medium to oxidize the sulfur compound, continuously removing electrolyzed product mixture from the electrolysis zone, and recovering the alkanesulfonic acid from the product mixture.

* * * * *